US009484131B2

(12) United States Patent
Specht et al.

(10) Patent No.: US 9,484,131 B2
(45) Date of Patent: Nov. 1, 2016

(54) METHOD AND DEVICE FOR POSITIONING ELECTRICAL CONDUCTORS, AND CONDUCTOR GROUP

(71) Applicant: Lisa Draexlmaier GmbH, Vilsbiburg (DE)

(72) Inventors: Klaus Specht, Geisenhausen (DE); Harald Sommavilla, St. Peter am Hart (AT); Andreas Neumayer, Geisenhausen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 14/753,881

(22) Filed: Jun. 29, 2015

(65) Prior Publication Data

US 2015/0380126 A1 Dec. 31, 2015

(30) Foreign Application Priority Data

Jun. 30, 2014 (DE) ..... 10 2014 109 141

(51) Int. Cl.

| | |
|---|---|
| ***H01B 3/30*** | (2006.01) |
| ***H01B 7/08*** | (2006.01) |
| ***H01B 13/012*** | (2006.01) |
| *H01B 7/00* | (2006.01) |

(52) U.S. Cl.

CPC ..... *H01B 13/01263* (2013.01); *H01B 7/0018* (2013.01)

(58) Field of Classification Search

CPC ..... H01B 13/01263; H01B 7/0018
USPC ..... 174/110 R, 117 F, 117 FF
See application file for complete search history.

(56) References Cited

U.S. PATENT DOCUMENTS

| | | | | |
|---|---|---|---|---|
| 4,457,068 | A | 7/1984 | Maier, Jr. | |
| 4,532,374 | A * | 7/1985 | Neuroth | H01B 7/0869 174/102 SP |
| 4,567,320 | A | 1/1986 | Neuroth et al. | |
| 5,105,055 | A * | 4/1992 | Mooney | H05K 1/024 174/117 FF |
| 5,147,510 | A * | 9/1992 | Iura | H01R 12/592 174/117 A |
| 7,304,234 | B2 | 12/2007 | Seki | |
| 7,395,680 | B2 * | 7/2008 | Baer | D04B 1/16 66/170 |
| 2003/0196828 | A1 * | 10/2003 | Schilson | B23K 20/106 174/117 F |
| 2004/0206545 | A1 | 10/2004 | Tracy et al. | |
| 2014/0196828 | A1 * | 7/2014 | Miyazaki | B60C 15/06 152/543 |

FOREIGN PATENT DOCUMENTS

| | | |
|---|---|---|
| DE | 10 2006 049 655 A1 | 5/2007 |
| DE | 20 2010 016 142 U1 | 3/2011 |
| DE | 10 2010 041 142 A1 | 3/2012 |
| WO | WO 2011/102013 A1 | 8/2011 |

* cited by examiner

*Primary Examiner* — Sherman Ng
(74) *Attorney, Agent, or Firm* — Finnegan, Henderson, Farabow, Garrett & Dunner LLP

(57) ABSTRACT

A method for positioning electrical conductors includes arranging a first flat conductor and a second flat conductor such that the second flat conductor is on top of the first conductor. The arranged conductors create a conductor group. The method also includes providing a wrapping tape. The wrapping tape is configured in such a manner that it is able to engage with itself, but not able to engage with the conductors. The method further includes wrapping the wrapping tape around the conductor group.

16 Claims, 9 Drawing Sheets

METHOD AND DEVICE FOR POSITIONING ELECTRICAL CONDUCTORS, AND CONDUCTOR GROUP

CROSS-REFERENCE TO RELATED APPLICATION

This application is based upon and claims the benefit of prior German Application No. 10 2014 109 141.8, filed on Jun. 30, 2014, the entire contents of which are incorporated herein by reference.

TECHNICAL FIELD

The present disclosure relates to a method for positioning electrical conductors with the aid of a wrapping tape that is wrapped around the conductors. The present disclosure further relates to a conductor group around which a wrapping tape is wrapped, and to a device for positioning electrical conductors.

BACKGROUND OF THE DISCLOSURE

An adhesive tape is known from DE 20 2010 016 142 U1, only a portion of the width of which is provided with an adhesive layer. When wrapped around a cable harness consisting of multiple cables, the longitudinally extending adhesive width of the adhesive tape provided with adhesive is placed against a cable and fixed thereon by way of the adhesive surface. When the cable harness is subsequently wrapped in a spiral-shaped manner, the cable harness is surrounded by the entire width of the tape. However only the width region of the adhesive tape not containing glue comes in contact with the cable harness. With every wrapping revolution of the adhesive tape around the cable harness, the respective width section that is provided with glue is brought in contact only with the subjacent adhesive tape from the prior wrapping. In this way, a kind of tunnel for the cable harness is created, so that subsequently it is still possible to bend the cable harness. However, displacing the cables of the cable harness with respect to each other is difficult, since the adhesive tape fixes the cables with respect to each other at the start. Moreover, the wrapping options are very limited, since attention is needed to ensure that, at all times, only the glue-less width region of the adhesive tape comes in contact with the cable. Cross wrappings and clearances between wrappings of the adhesive tape are therefore not possible without creating additional connections to the cable harness, whereby the desired tunnel effect is impaired.

SUMMARY

It is an object of the present invention to provide a method for positioning electrical conductors which grants greater flexibility in terms of wrapping options and in terms of compensating for tolerances between the conductors. Further objects include providing a conductor group produced by the method and a device based on the method.

Accordingly, embodiments consistent with the present disclosure include a method for positioning electrical conductors, in which initially at least two conductors are arranged with respect to each other so as to form a conductor group. In some embodiments, at least one conductor is dimensionally stable. For example, the at least one conductor may be a flat conductor, which is made of aluminum or an aluminum alloy, for example. Accordingly, the described conductor group can be a flat conductor group. In some embodiments, the conductor group may include one or more circular conductors arranged on one or more flat conductors.

According to the method, a wrapping tape is provided which is designed in such a way that it is able to engage itself, but not the conductors. According to the present disclosure, this wrapping tape is wrapped around the conductor group.

After wrapping, the wrapping tape has generally engaged itself in multiple locations. As a result of wrapping the tape, the conductors are fixed with respect to each other in at least one direction. However, since the wrapping tape does not engage the conductors, it is still possible to conveniently bend the conductor group. Moreover, it is possible to compensate for tolerances between the individual conductors even after wrapping. For example, the conductors can be displaced with respect to each other along the main extension axis thereof. According to the present disclosure, arbitrary wrappings, such as cross wrappings, variations in the overlap depth, and clearances, can be implemented. In this way, the design of the wrappings can be individually adapted to the conductors, including the terminal elements, such as protruding terminal lugs.

For example, the wrapping tape can be designed so as to engage with itself in an adhesively bonded manner, without forming a connection with the conductors. An adhesively bonded connection within the scope of the present disclosure may be understood to mean above all a detachable, gripping connection. The wrapping tape can be an adhesion tape, for example. In some embodiments, a glue-less adhesion tape is used, which can be made of polyvinyl chloride, for example. The inherent grip of the adhesion tape is generated by the restoring force that is introduced during wrapping. In some embodiments, the adhesion tape is made of a plastic material, which is stretched when being wrapped around the conductors and pulled back by the elastic component of the plastic material.

Likewise, it is possible for the wrapping tape to be designed in such a way that it is able to engage with itself in a form-locked manner. In some embodiments, this form-locked connection is also detachable. Such a form-locked connection can be achieved by way of a double-sided hook-and-loop tape, for example.

The advantage of using a hook-and-loop tape is that the connection is established exclusively between the hook-and-loop tapes, and consequently no connection is created with the conductor group to be wrapped. For example, the hook-and-loop tape can comprise loops, mushroom-shaped heads, velour, hooks, or a combination thereof. The design of the hook-and-loop tape can be kept very filigree or coarse.

Considerable advantages are achieved by the adhesively bonded or form-locked connection being detachable again, especially in repair situations. It is therefore also possible to easily and conveniently correct potential wrapping errors during installation.

In some embodiments, the conductor group around which the wrapping tape has been wrapped is bent. Two-dimensional or three-dimensional bending is conceivable for this purpose. Bending lends itself in particular when at least one of the conductors of the conductor group is dimensionally stable. As mentioned above, such a dimensionally stable conductor can be a flat conductor, for example, which is made of aluminum or an aluminum alloy, for example. Because the wrapping tape is only engaged with itself, but not with the conductors, the wrapping tape forms a kind of tunnel for the conductor group. The different inner and outer radii created at the curvature as a result of bending therefore do not result in stresses or extensions or compressions in the wrapping tape, whereby bending can be carried out easily and non-destructively.

The method provides a high degree of flexibility with respect to the design of the wrappings. For example, the wrapping tape can be wrapped several times around the conductor group along the main extension axis of the tape. For example, two consecutive wrappings of the wrapping tape can have an overlap between 20 to 50 percent of a width of the wrapping tape. The width, of course, runs perpendicularly to the main extension axis of the wrapping tape. A wrapping tape could have a width between 5 and 50 mm, for example.

In some embodiments, the wrapping tape can also have a relatively large width, so as to allow wrapping along the width of the wrapping tape. In this embodiment, the wrapping tape is wrapped around the conductor group in such a way that a main extension axis of the wrapping tape subsequently runs parallel to a main extension axis of the conductor group. In this embodiment, the wrapping tape can be wrapped two to five times around the conductor group, for example.

In some embodiments, an adhesive tape is additionally provided, which is wrapped around the wrapping tape that has already been wrapped around the conductor group. The adhesive tape can be an adhesive cloth tape, for example. The adhesive tape additionally stabilizes the wrapping, without the adhesive tape clinging to the conductors because it comes in contact only with the wrapping tape. The described tunnel effect is therefore not impaired. Apart from additional stabilization, the adhesive tape moreover protects the conductor group against mechanical or chemical damage, or serves as an electric shield. The adhesive tape, in turn, can be wrapped several times around the conductor group along the main extension axis of the tape, or it can be wrapped around the conductor group in such a way that a main extension axis of the adhesive tape runs parallel to a main extension axis of the conductor group.

In some embodiments, the conductor group is attached in a body of a motor vehicle with the aid of the wrapping tape. In this way, the conductor group can no longer shift in the body. In some embodiments, the attachment is carried out with the aid of the wrapping tape in such a way that it is detachable. For example, the attachment of the conductor group in the body can include a wrapping of the wrapping tape around attachment elements in the body. Ends of the wrapping tape are wrapped around the attachment elements, for example. Subsequent fastening with knots is also conceivable.

When the wrapping tape is designed as a double-sided hook-and-loop tape, an additional hook-and-loop tape can be attached in the body, and the conductor group can be connected in a form-locked manner to the additional hook-and-loop tape using the wrapping tape. The step of attaching the conductor group in the body can therefore include connecting the wrapping tape to a hook-and-loop tape attached in the body. The hook-and-loop tape on the body side can be without hook-and-loop elements on one side, for example, and be glued into the body on this side.

In some embodiments, a housing is arranged around at least a portion of the conductor group, wherein the housing compresses the wrapping tape in such a way that sealing is achieved between the housing and the conductor group. In this way, the wrapping tape simultaneously acts as a sealing element, whereby no additional sealing element is required. It is conceivable for the wrapping tape to be wrapped several times around the conductor group in contact areas in which the housing comes in contact with the conductor group. A thickness of the wrapping is therefore thicker in the contact areas than in other areas, whereby particularly good sealing is achievable in the contact areas.

According to a further aspect of the present disclosure, there is provided a conductor group including at least two electrical conductors around which a wrapping tape is wrapped so as to position the conductors with respect to each other, wherein the wrapping tape is only engaged with itself, but not with the conductors. As was already described above, the conductors can in particular be flat conductors, so that the conductor group can also be referred to as a flat conductor group. The wrapping tape may be engaged with itself in an adhesively bonded or form-locked manner. The wrapping tape can be an adhesion tape, for example, in particular a glue-less adhesion tape, made of, for example, polyvinyl chloride. The wrapping tape can also be a double-sided hook-and-loop tape. The wrapping tape can be wrapped around the conductors in such a way that cross wrappings, variations in the overlap depth between the individual wrappings, or clearances between the individual wrappings exist.

In some embodiments, a housing is arranged around at least a portion of the conductor group, the housing being sealed with the aid of the wrapping tape.

According to still another aspect of the present disclosure, there is provided a device for positioning electrical conductors with respect to each other. This device comprises a wrapping unit for wrapping a wrapping tape around a conductor group. The conductor group comprises at least two conductors. In some embodiments, at least one of the at least two conductors is dimensionally stable. The described dimensionally stable conductor may in particular be a flat conductor, which is made of aluminum or an aluminum alloy, for example. In some embodiments, all conductors are flat conductors, so that the conductor group can also be referred to as a flat conductor group. As was already described above, the wrapping tape is also designed in the device in such a way that it is able to engage with itself, but not with the conductors. In addition to the wrapping unit, the device according to the present disclosure comprises a bending unit for bending the conductor group after wrapping.

Because the wrapping tape only engages with itself, but not with the conductors, the conductor group can still have a straight shape when being wrapped along the main extension axis thereof, whereby mechanical wrapping is easily possible. Thereafter, the wrapped conductor group can still be bent into the desired shape without difficulty, as was already described in more detail above.

The invention was described with respect to a method, a conductor group, and a device. Unless indicated otherwise, the descriptions made regarding the method can be applied analogously to the conductor group and the device. It goes without saying that the same also applies conversely so that the embodiments of the conductor group and of the device also are also reflected in the method.

BRIEF DESCRIPTION OF THE FIGURES

Further details and advantages of embodiments of the invention will be described hereafter with reference to the figures.

DESCRIPTION OF EMBODIMENTS

Figure 1:
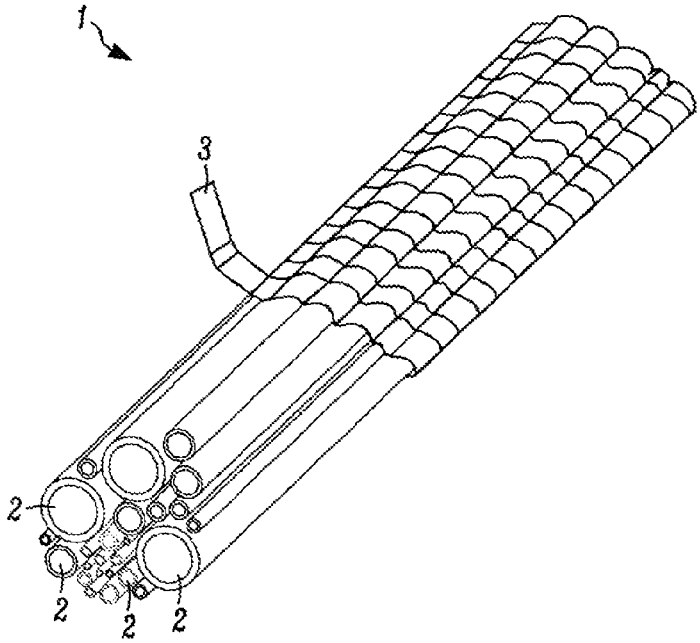
FIG. 1 shows a conductor group according to an exemplary embodiment.

Elements in the drawings that are identical and act alike are denoted by the same reference numerals in the following description, unless indicated otherwise.

FIG. 1 illustrates an exemplary conductor group 1 according to the present disclosure. The conductor group 1 includes multiple electrical conductors 2, around which the wrapping tape 3 is wrapped. The wrapping tape 3 holds the conductors 2 together and positions them with respect to each other. The wrapping tape 3 is a glue-less adhesion tape made of polyvinyl chloride. This tape only clings to itself, but not to the conductors 2.

Figure 2:
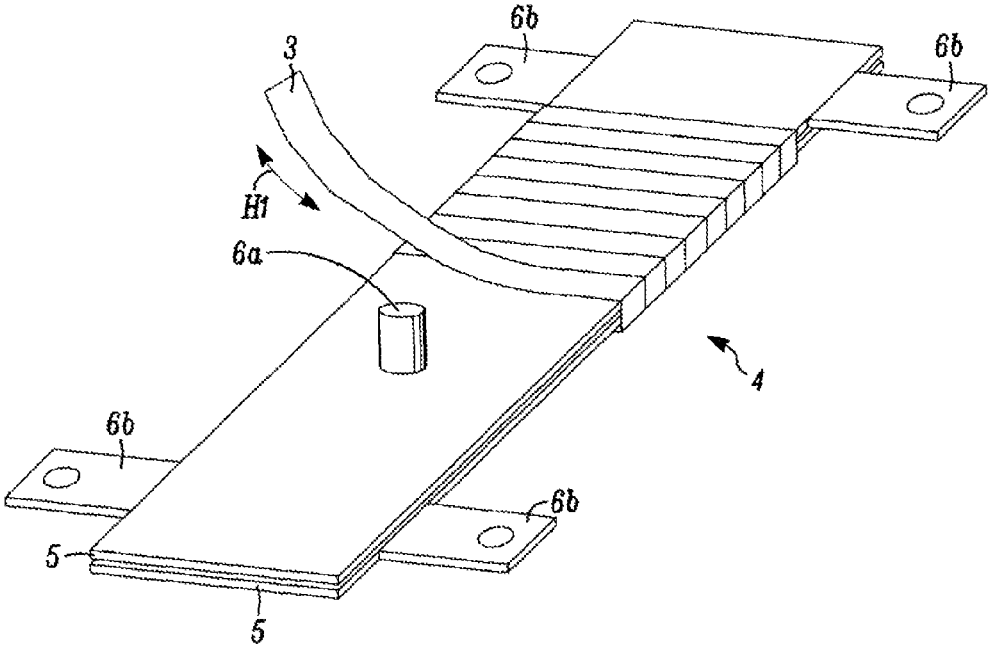
FIG. 2 shows a flat conductor group, around which a wrapping tape is wrapped.
Figure 3:
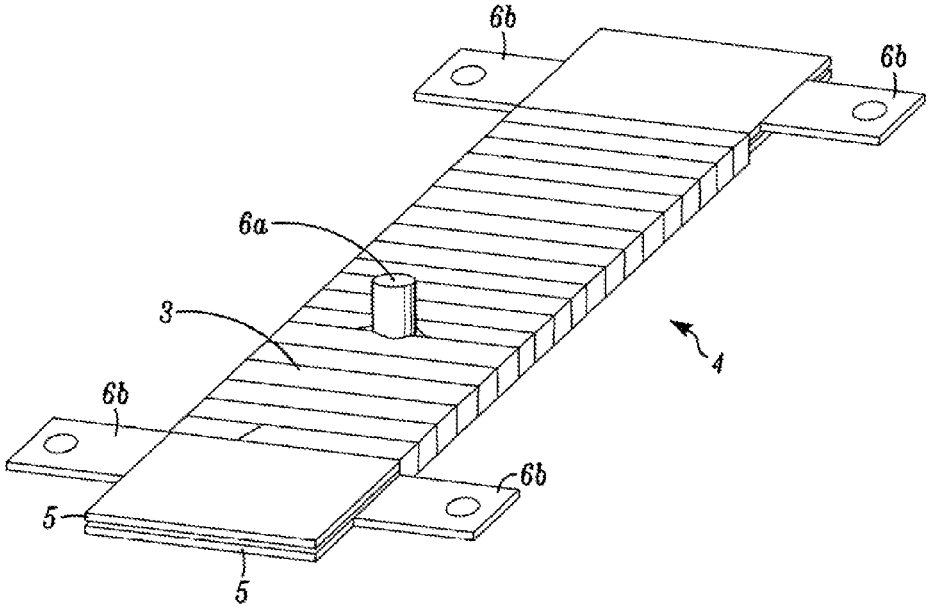
FIG. 3 shows a conductor group according to another exemplary embodiment.

FIG. 2 illustrates another exemplary conductor group 4 according to the present disclosure. The conductor group 4 comprises two flat conductors 5, so that the conductor group 4 can also be referred to as a flat conductor group. Various terminals 6*a* and fixation elements 6*b* are arranged on the flat conductors 5, via which power can be withdrawn from and supplied to the flat conductors 5. The flat conductors 5 are again positioned with respect to each other by way of a glue-less adhesion tape made of polyvinyl chloride. As shown in FIG. 2, the wrapping tape 3 is wrapped multiple times around the conductor group 4, which includes the two flat conductors 5, along the main extension axis H1 of the tape. The wrappings of the wrapping tape 3 have an overlap of approximately 25 percent of the width of the wrapping tape 3. FIG. 3 shows the conductor group 4 after the wrapping tape 3 has been wrapped completely around the conductor group 4. One of the terminals 6*a* of the flat conductors 5 projects out through the wrappings of the wrapping tape 3.

Figure 4:
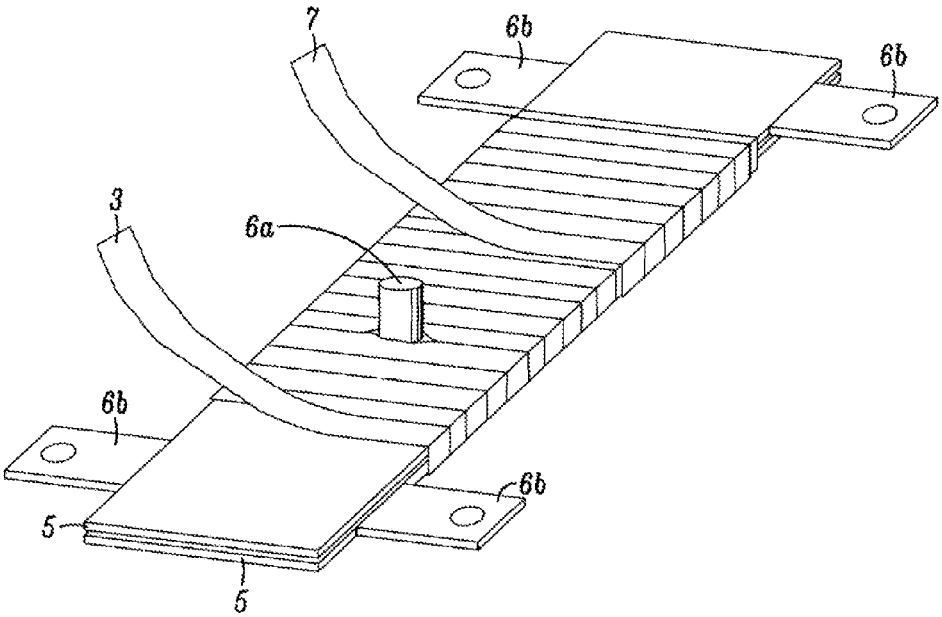
FIG. 4 shows the conductor group, around which additionally an adhesive tape is wrapped.

As is illustrated in FIG. 4, an adhesive tape 7 may be wrapped around the the conductor group 4, so as to additionally stabilize the wrapping and provide further mechanical, chemical, or electromagnetic protection of the flat conductors 5.

Figure 5:
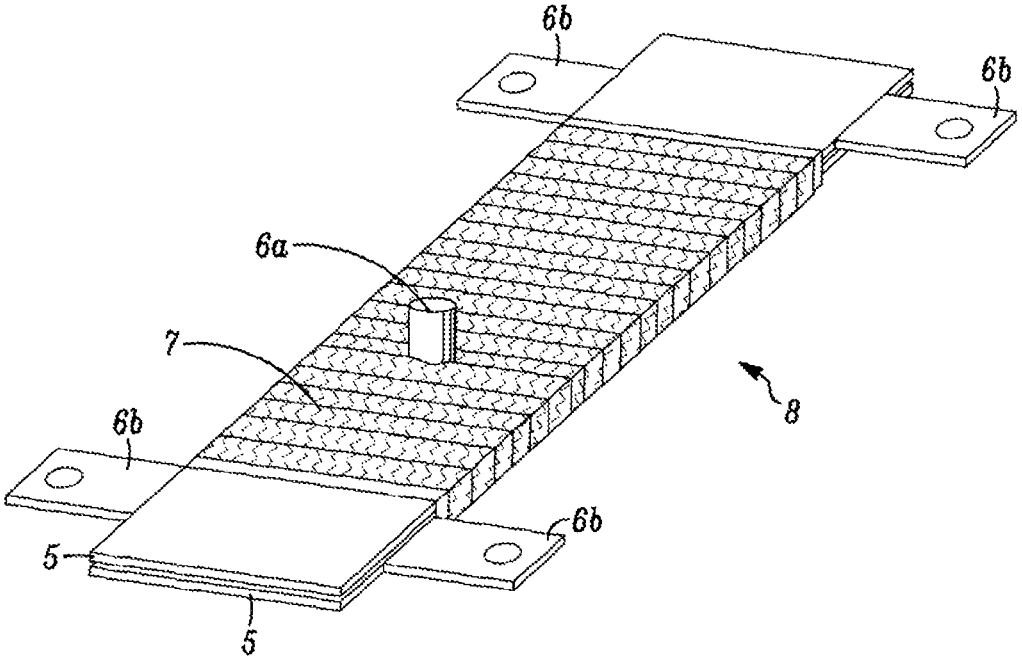
FIG. 5 shows a conductor group according to another exemplary embodiment.

FIG. 5 shows another exemplary conductor group 8 according to the present disclosure. The conductor group 8 is similar to the conductor group 4, except that the conductor group 8 has the adhesive tape 7 wrapped completely around the wrapping tape 3.

Figure 6:
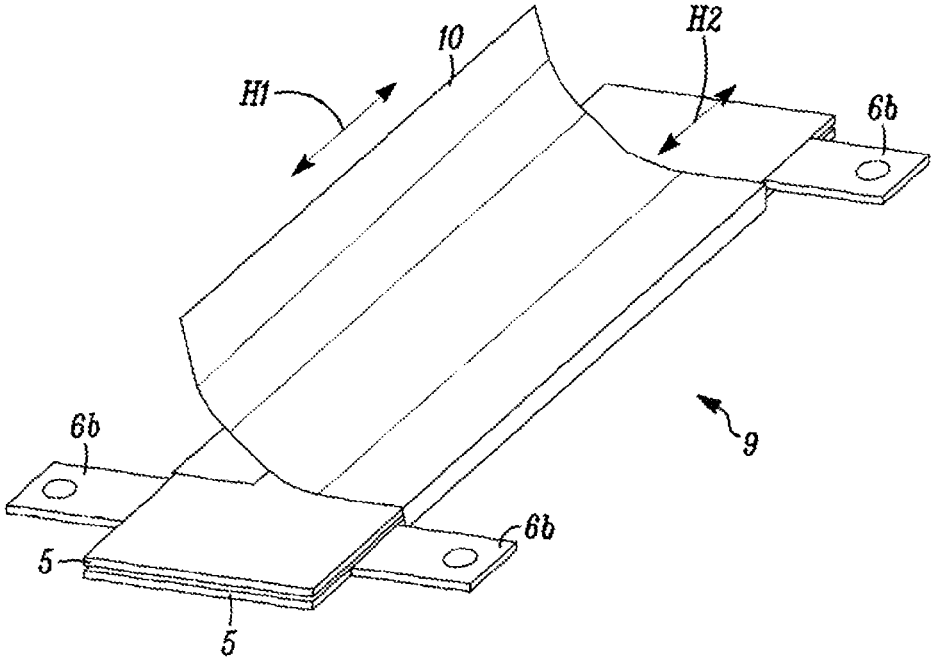
FIG. 6 shows a flat conductor group, around which a wide wrapping tape is wrapped.
Figure 7:
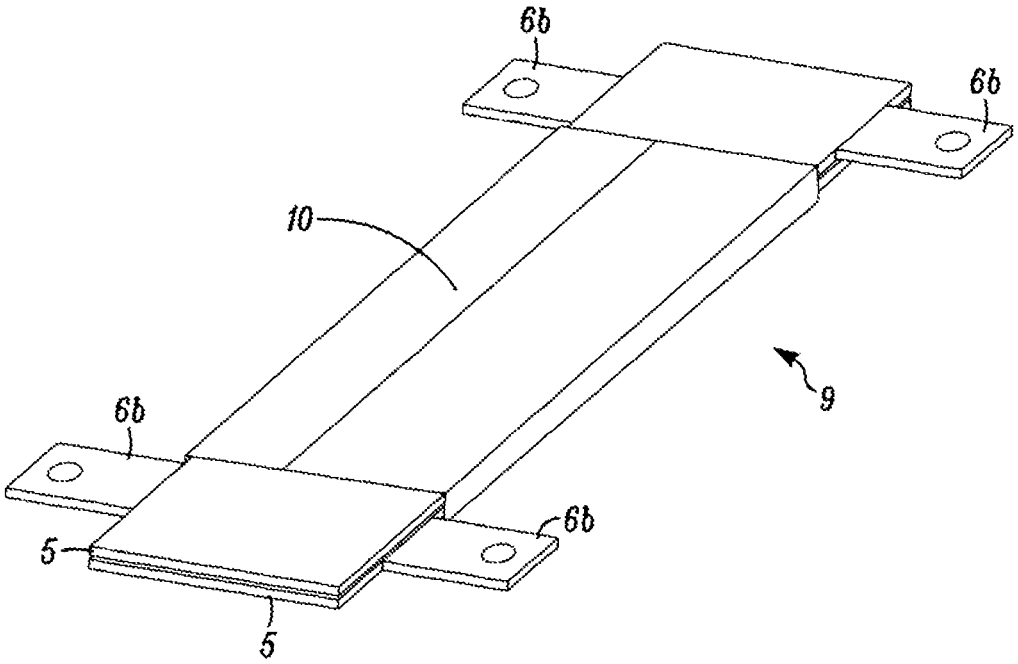
FIG. 7 shows a conductor group according to another exemplary embodiment.

FIG. 6 shows another exemplary conductor group 9 according to the present disclosure. The conductor group 9 differs from the conductor groups 4 and 8 described above in that a wrapping tape 10 is wrapped around the conductor group 9 in such a way that a main extension axis H1 of the wrapping tape runs parallel to a main extension axis H2 of the conductor group 9. In other words, the wrapping tape 10 is considerably wider than the wrapping tape 3 shown in FIG. 2, for example. In this way, the wrapping tape 10 can be wrapped around the conductor group 9 transversely instead of longitudinally. FIG. 7 shows the conductor group 9 after the wrapping tape 10 has been wrapped completely around the conductor group 9.

Figure 8:
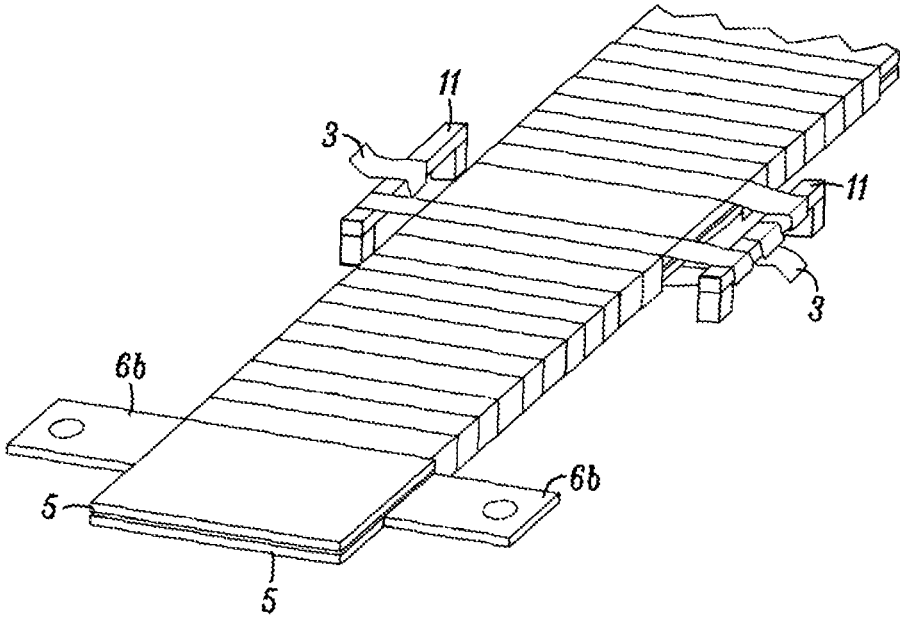
FIG. 8 shows a flat conductor group, which is attached in the body using attachment elements.

FIG. 8 illustrates how a conductor group can be attached in the body of a motor vehicle by wrapping the ends of the wrapping tape 3 around attachment elements 11 of the body.

Figure 9:
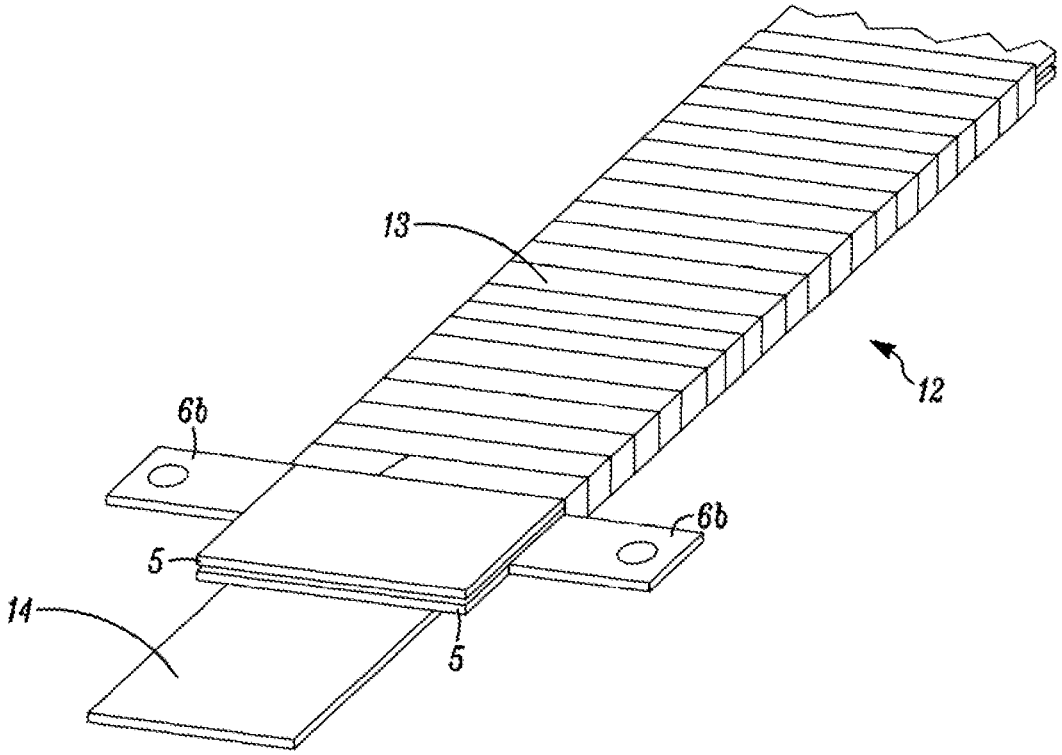
FIG. 9 shows a conductor group according to another exemplary embodiment, which is attached in the body using a hook-and-loop tape.

An alternative attachment method is shown in FIG. 9, which shows anther exemplary conductor group 12 according to the present disclosure. The conductor group 12 is wrapped with a double-sided hook-and-loop tape 13. A single-sided hook-and-loop tape 14 has been glued into the body of the motor vehicle, so that the conductor group 12 can be fastened to the hook-and-loop tape 14 using the wrapping tape 13.

Figure 10:
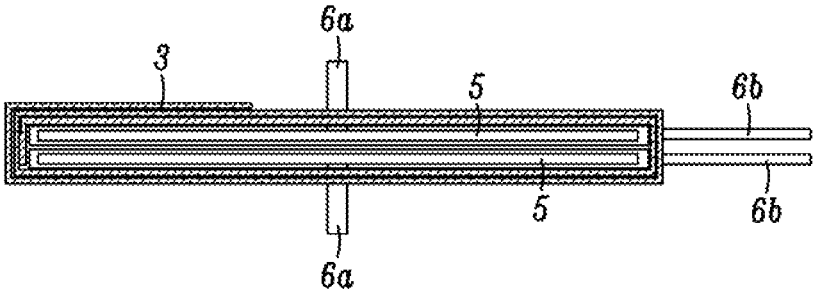
FIG. 10 shows a sectional view of a flat conductor group according to an exemplary embodiment.
Figure 11:
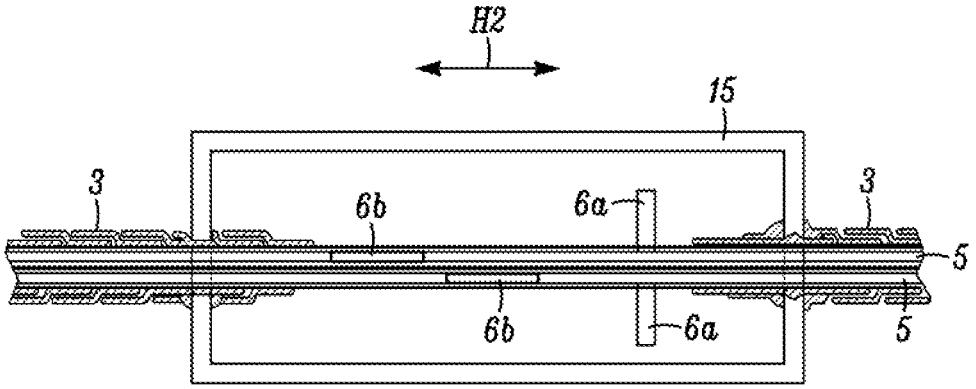
FIG. 11 shows a flat conductor group comprising a housing.

FIG. 10 shows a sectional view of a conductor group. The flat conductors 5 again have multiple terminals 6*a* and fixation elements 6*b*, wherein the wrapping tape 3 is wrapped around the flat conductors 5. The conductor group from FIG. 10 is shown in FIG. 11 in such a way that the main extension axis H2 of the conductor group runs from left to right. FIG. 11 shows the different layers of the wrapping tape 3. A housing 15 is arranged around a portion of the conductor group in such a way that sealing is achieved between the housing 15 and the conductor group as a result of the wrapping tape 3.

Figure 12:
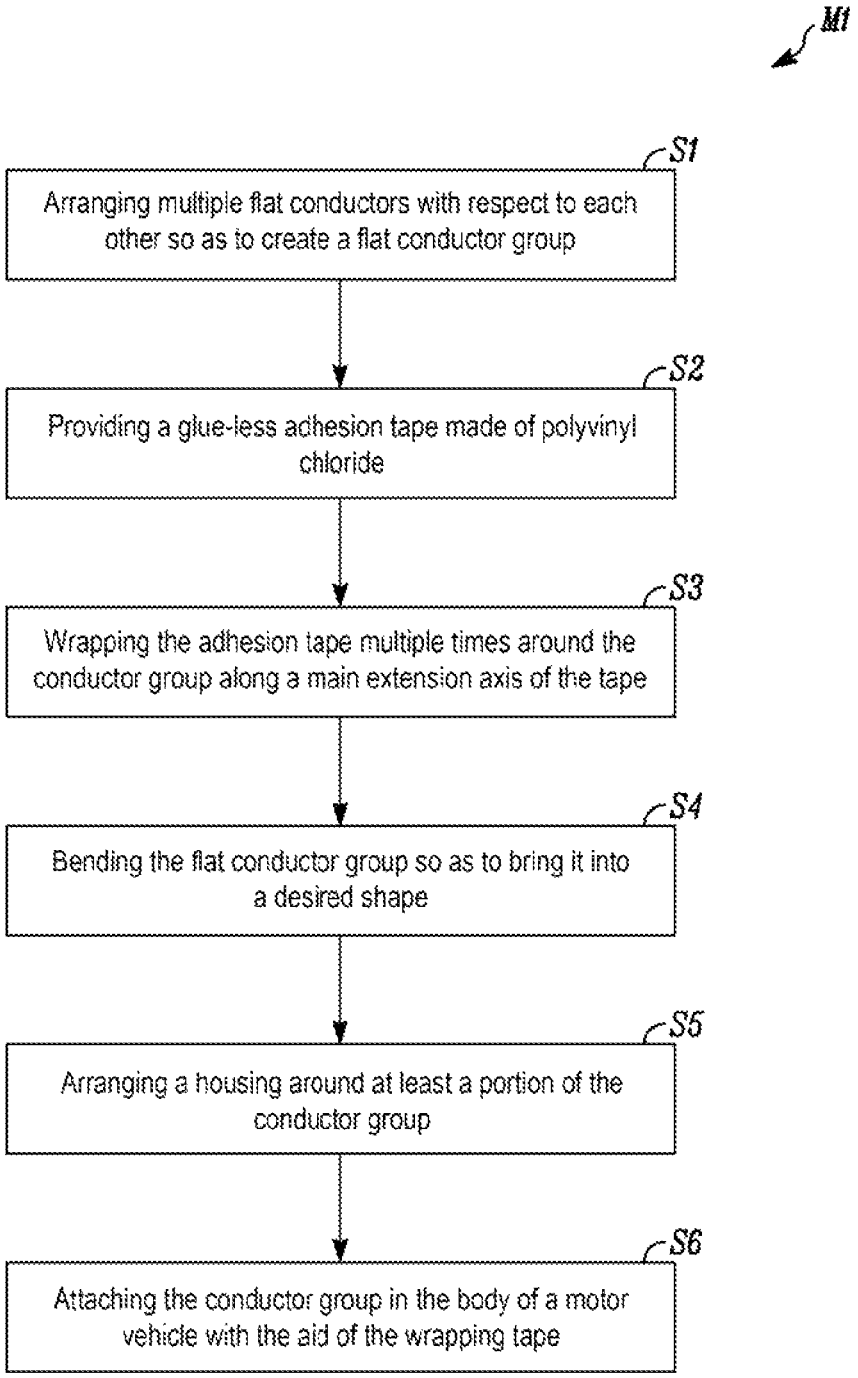
FIG. 12 shows a method according to an exemplary embodiment.

FIG. 12 shows an exemplary method M1 according to the present disclosure. According to the method M1, at S1, multiple flat conductors are arranged with respect to each other so as to create a flat conductor group. At S2, a glue-less adhesion tape made of polyvinyl chloride is provided. At S3, the adhesion tape is wrapped multiple times around the conductor group along a main extension axis of the tape. In some embodiments, the adhesion tape is wrapped multiple times around the conductor group in contact areas in which a housing later will come in contact with the conductor group, so as to create a thick wrapping portion in the contact areas. At S4, the flat conductor group is bent so as to bring it into a desired shape. At S5, a housing is arranged around at least a portion of the conductor group, so that sealing of the housing is achieved by the wrapping tape. At S6, the conductor group is attached in the body of a motor vehicle with the aid of the wrapping tape, for example by wrapping the ends of the wrapping tape around attachment elements in the body.

Figure 13:
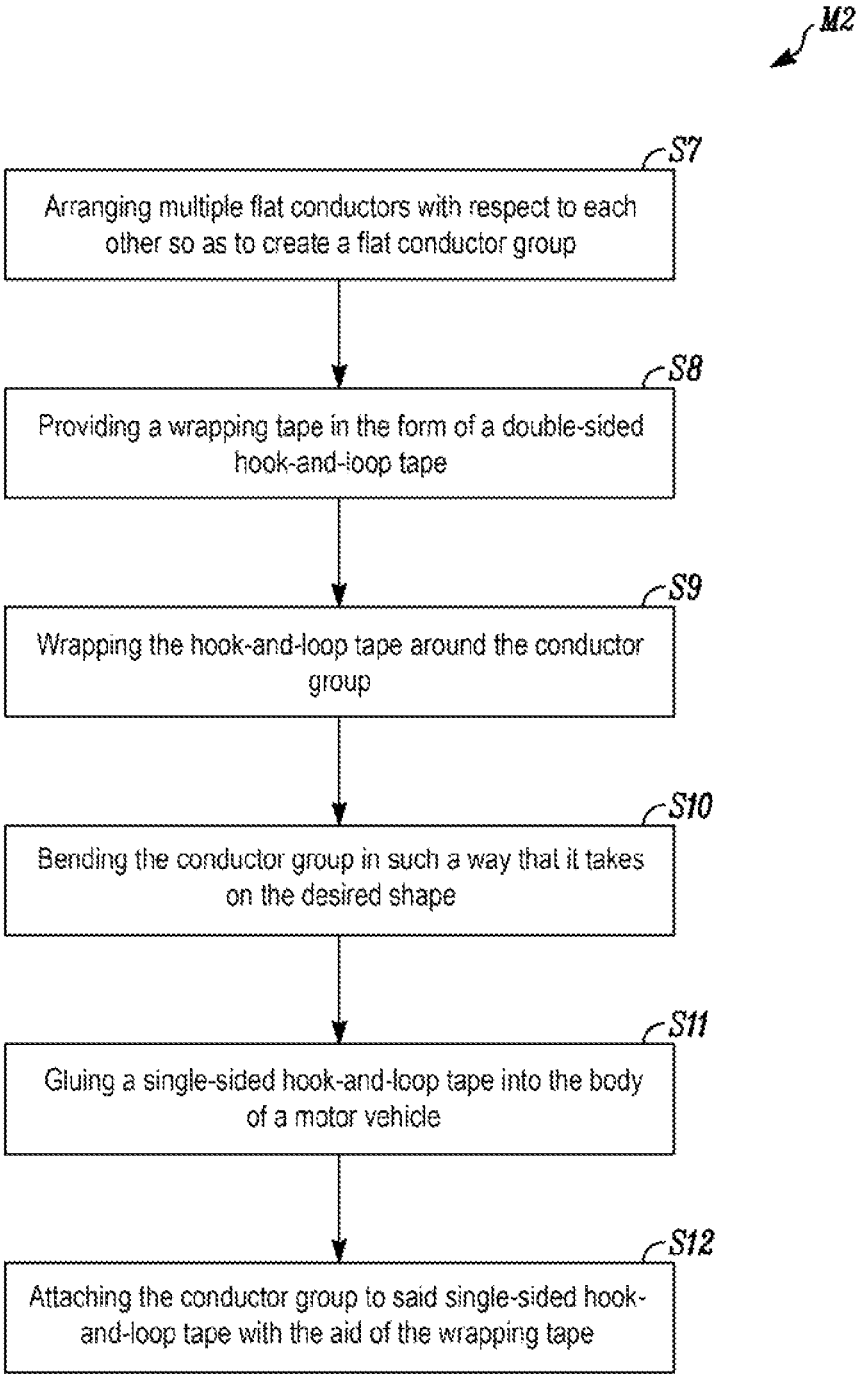
FIG. 13 shows a method according to another exemplary embodiment.

FIG. 13 illustrates another exemplary method M2 according to the present disclosure. According to the method M2, at S7, multiple flat conductors are arranged with respect to each other so as to create a flat conductor group. At S8, a wrapping tape in the form of a double-sided hook-and-loop tape is provided. At S9, the hook-and-loop tape is wrapped around the conductor group. At S10, the conductor group is bent in such a way that it takes on the desired shape. At S11, a single-sided hook-and-loop tape is glued into the body of a motor vehicle. At S12, the conductor group is attached to said single-sided hook-and-loop tape with the aid of the wrapping tape.

Figure 14:
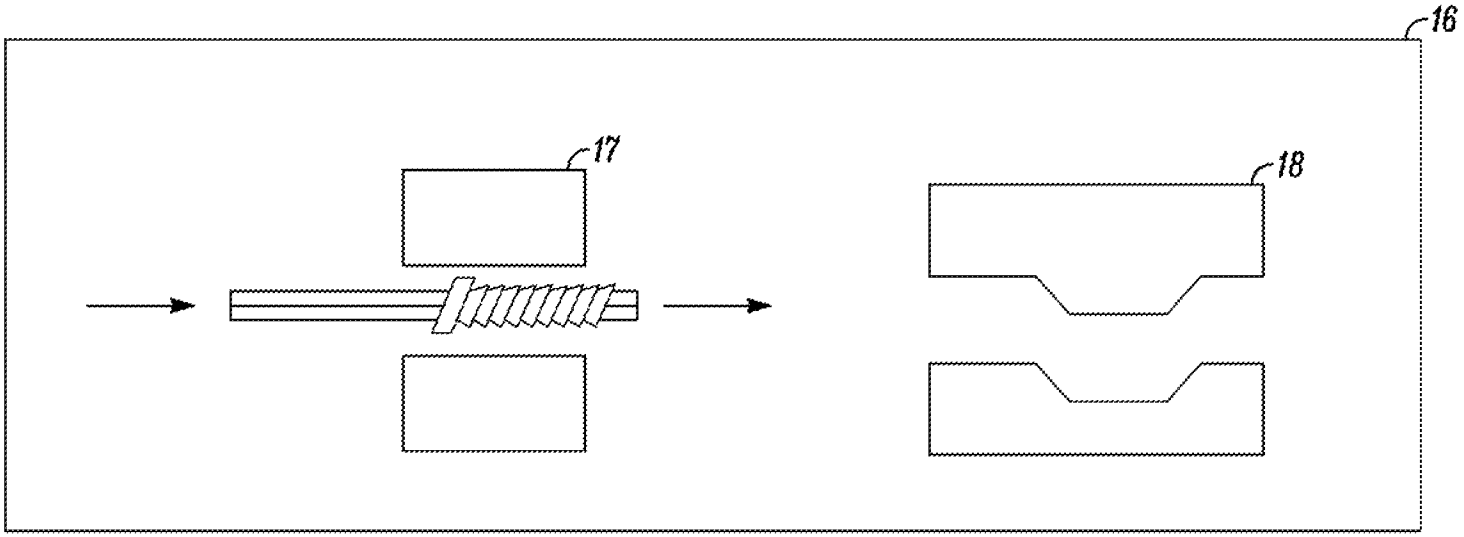
FIG. 14 shows a device according to an exemplary embodiment.

FIG. 14 shows an exemplary device according to the present disclosure for positioning electrical conductors with respect to each other. The device 16 comprises a wrapping unit 17 for wrapping a wrapping tape, which is designed in such a way that it is able to engage with itself, but not with the conductors, around a conductor group, which includes at least two conductors. Moreover, the device 16 comprises a bending unit 18, which is able to bend the conductor group after wrapping.

The wrapping tape that is used can be the glue-less PVC adhesion tape Certoplast 660, for example. The double-sided hook-and-loop tape may include at least one of the following, for example, VELCRO® BACK-TO-BACK hook and loop fastener, VELCRO® ONE-WRAP® cable ties, VELCRO® Double Face 200 double-sided soft hook-and-loop tape, VELCRO® Ultra-Mate® MVA-8 hook tape.

The following advantages can optionally be achieved by the present disclosure:

The conductor group can still be bent after wrapping.

The conductor group is mechanically protected by the wrapping tape.

The conductors are fixed with respect to each other. Nonetheless, a certain level of tolerance compensation is still possible.

Because the flat conductors are seated particularly closely together as a result of wrapping, the inductive resistance of the flat conductor group can improve.

Because the conductors are seated closely together, electrical and magnetic fields outside the flat conductor group can be reduced.

The wrapping can be detached again for repairs or additions.

Wrapping using a wrapping tape weighs less than enclosing by potting or a housing.

Wrapping is a cost-effective alternative to the injection molding of housings or encapsulation.

A cable duct is not required.

In terms of the wrapping technique, the invention offers a high degree of flexibility.

The 2D wrapping technique can be easily automated and is already used in production for wiring harnesses.

The wrapping tape can be used to attach the conductor group in the vehicle body.

The wrapping tape can be cut to arbitrary sizes.

The wrapping direction is arbitrary.

The wrapping tape can be used to seal housings.

The explanations provided with reference to the figures are merely illustrative and shall not be understood to have any limiting effect. It is possible to make various modifications to the described embodiments without departing from the scope of protection as it is defined in the accompanying claims.

LIST OF REFERENCE NUMERALS

1 first exemplary conductor group
2 conductor
3 wrapping tape
4 second exemplary conductor group
5 flat conductor
6*a* terminal
6*b* fixation element
7 adhesive tape
8 third exemplary conductor group
9 fourth exemplary conductor group
10 wrapping tape
11 attachment elements
12 fifth exemplary conductor group
13 double-sided hook-and-loop tape
14 hook-and-loop tape attached in the body
15 housing
16 device
17 wrapping unit
18 bending unit
H1 main extension axis of the wrapping tape
H2 main extension axis of the conductor group
M1 first exemplary method
M2 second exemplary method
S1 arranging at least two conductors with respect to each other
S2 providing an adhesion tape
S3 wrapping the adhesion tape around the conductor group
S4 bending the conductor group
S5 arranging a housing around at least a portion of the conductor group
S6 attaching the conductor group in the body of the motor vehicle
S7 arranging at least two conductors with respect to each other
S8 providing a double-sided hook-and-loop tape
S9 wrapping the hook-and-loop tape around the conductor group
S10 bending the conductor group
S11 attaching a hook-and-loop tape in the body of a motor vehicle
S12 attaching the conductor group to the hook-and-loop tape

The invention claimed is:

1. A method for positioning electrical conductors, comprising:

arranging a first flat conductor and a second flat conductor such that the second flat conductor is on top of the first conductor, wherein the arranged conductors create a conductor group;

providing a wrapping tape, the wrapping tape being configured in such a manner that it is able to engage with itself, but not able to engage with the conductors; and wrapping the wrapping tape around the conductor group.

2. The method according to claim 1, wherein providing the wrapping tape includes providing a wrapping tape configured in such a way that it is able to engage with itself in an adhesively bonded manner or a form-locked manner.

3. The method according to claim 2, wherein providing the wrapping tape includes providing a glue-less adhesion tape or a double-sided hook-and-loop tape.

4. The method according to claim 1, further comprising: bending the conductor group.

5. The method according to claim 1, wherein wrapping the wrapping tape includes wrapping the wrapping tape around the conductor group along a main extension axis of the wrapping tape for more than one round such that portions of the wrapping tape in two consecutive rounds have an overlap between 20 and 50 percent of a width of the wrapping tape.

6. The method according to claim 1, wherein wrapping the wrapping tape includes wrapping the wrapping tape around the conductor group in such a manner that a main extension axis of the wrapping tape runs parallel to a main extension axis of the conductor group.

7. The method according to claim 1, further comprising: providing an adhesive tape; and wrapping the adhesive tape over the wrapping tape that has been wrapped around the conductor group.

8. The method according to claim 1, further comprising:

attaching the conductor group in a body of a motor vehicle using the wrapping tape.

9. The method according to claim 8, wherein the attaching the conductor group in the body includes wrapping a portion of the wrapping tape around at least one attachment element in the body.

10. The method according to claim 8, wherein:

the wrapping tape includes a first hook-and-loop tape, and attaching the conductor group in the body includes connecting the first hook-and-loop tape to a second hook-and-loop tape attached in the body.

11. The method according to claim 1, further comprising:

arranging a housing around at least a portion of the conductor group, the housing being configured to compress the wrapping tape to achieve sealing between the housing and the conductor group.

12. The method according to claim 11, wherein:

arranging the housing includes arranging the housing such that the housing contacts the conductor group in at least one contact area, and wrapping the wrapping tape includes wrapping the wrapping tape around the conductor group in the at least one contact area for more than one round.

13. A conductor group, comprising:

a first flat electrical conductor;

a second flat electrical conductor arranged on top of the first flat electrical conductor; and a wrapping tape wrapped around the flat electrical conductors, the wrapping tape being configured in such a manner that it is able to engage with itself, but not able to engage with the conductors.

14. The conductor group according to claim 13, wherein the wrapping tape includes a glue-less adhesion tape or a double-sided hook-and-loop tape.

15. A conductor assembly comprising:

the conductor group according to claim 13; and a housing arranged around at least a portion of the conductor group, the housing being sealed by the wrapping tape.

16. A device for positioning electrical conductors with respect to each other, comprising:

a wrapping unit configured to wrap a wrapping tape around a conductor group including at least two conductors, the wrapping tape being configured in such a manner that it is able to engage with itself, but not able to engage with the conductors; and a bending unit configured to bend the conductor group after the wrapping unit wraps the wrapping tape.

* * * * *